US007530667B2

(12) United States Patent
Furukawa et al.

(10) Patent No.: US 7,530,667 B2
(45) Date of Patent: May 12, 2009

(54) NOZZLE PLATE AND METHOD OF MANUFACTURING NOZZLE PLATE

(75) Inventors: Gentaro Furukawa, Kanagawa (JP); Toshiya Kojima, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 438 days.

(21) Appl. No.: 11/390,139

(22) Filed: Mar. 28, 2006

(65) Prior Publication Data

US 2006/0221138 A1 Oct. 5, 2006

(30) Foreign Application Priority Data

Mar. 29, 2005 (JP) ..... 2005-094363

(51) Int. Cl.
*B41J 2/135* (2006.01)
*B41J 2/14* (2006.01)

(52) U.S. Cl. ..... 347/45; 347/47

(58) Field of Classification Search ..... 347/45, 347/47

See application file for complete search history.

(56) References Cited

U.S. PATENT DOCUMENTS 7,267,427 B2 * 9/2007 Miura et al. ..... 347/47

FOREIGN PATENT DOCUMENTS

JP 9-76492 A 3/1997
JP 2004-181883 A 7/2004

* cited by examiner

*Primary Examiner*—An H Do
(74) *Attorney, Agent, or Firm*—Birch, Stewart, Kolasch & Birch, LLP

(57) ABSTRACT

The method manufactures a nozzle plate in which a liquid-repelling film is formed on a surface of a nozzle forming substrate having nozzle holes for ejecting liquid droplets, the surface being on a droplet ejection side of the nozzle forming substrate. The method includes the steps of: a spreading step of spreading sealing members for sealing the nozzle holes, over the surface of the nozzle forming substrate on the droplet ejection side; a drawing step of drawing the sealing members by suction through the nozzle holes, from another side of the nozzle forming substrate reverse to the droplet ejection side; a first removal step of removing a surplus of the sealing members present on the surface of the nozzle forming substrate on the droplet ejection side; an application step of applying a liquid-repelling agent onto the surface of the nozzle forming substrate on the droplet ejection side; a curing step of curing the liquid-repelling agent applied to the surface of the nozzle forming substrate on the droplet ejection side; and a second removal step of removing the sealing members from the nozzle holes.

6 Claims, 7 Drawing Sheets

NOZZLE PLATE AND METHOD OF MANUFACTURING NOZZLE PLATE

BACKGROUND OF THE INVENTION

1. Field of the Invention

The present invention relates to a nozzle plate and a method of manufacturing a nozzle plate, and more particularly, to a method of manufacturing a nozzle plate in which a liquid-repelling film is formed on the surface thereof on the droplet ejection side.

2. Description of the Related Art

An inkjet type of image forming apparatus comprises a print head having a nozzle plate in which a plurality of nozzles (nozzle holes) are formed, and the image forming apparatus forms an image on a recording medium by ejecting ink droplets from these nozzles.

In order to stabilize the direction of flight of the ink droplets ejected from the nozzles, a liquid-repelling film is conventionally formed on the surface of the nozzle plate on the droplet ejection side. This is because, if there are ink droplets attached to the surface of the nozzle plate on the ink droplet ejection side (and in particular, in the periphery of the nozzles), then they can affect the direction of flight of the ink droplets ejected from the nozzles. By forming the liquid-repelling film, the ink droplets adhering to the surface of the nozzle plate on the ink droplet ejection side can be removed more readily by means of a blade or the like.

As a method of manufacturing a nozzle plate of this kind, Japanese Patent Application Publication No. 9-76492, for example, discloses a method in which a dry film resist made of a corrosion-resistant high polymer resin, such as a photosensitive film, or the like, is filled into the nozzles, the dry film is made to project by cutting by etching, and a surface treatment layer is then formed, whereupon the dry film is removed.

However, in the method in which the resist is filled into the nozzles, there is a problem in that the number of manufacturing steps for the nozzle plate increases and the work becomes more complicated. In particular, if the nozzle plate is large in size or complicated in shape, then the process of manufacturing the nozzle plate becomes more complicated and this leads to an increased number of manufacturing steps.

Furthermore, Japanese Patent Application Publication No. 2004-181883 discloses a method in which a liquid-repelling treatment liquid is applied onto the ink ejection surface of the nozzle plate by spin-coating, while introducing air into the nozzle holes from the other side of the nozzle plate reverse to the ink ejection surface, whereupon the nozzle plate is heat treated.

However, in the method in which the liquid-repelling treatment liquid is applied while introducing air into the nozzle holes, it is difficult to apply a highly viscous treatment liquid, and to form a thick film of the treatment liquid, due to the effects of the air flow, and therefore it is difficult to form a secure liquid-repelling film on the surface of the nozzle plate. Furthermore, if the nozzle plate is large in size, or is made to contain a large number of nozzles, then it is difficult to control the air pressure, due to the deformation of the nozzle plate as a result of the air pressure.

SUMMARY OF THE INVENTION

The present invention has been contrived in view of the foregoing circumstances, an object thereof being to simplify the process of manufacturing a nozzle plate in which a liquid-repelling film is formed on the surface on the droplet ejection side.

In order to attain the aforementioned object, the present invention is directed to a method of manufacturing a nozzle plate in which a liquid-repelling film is formed on a surface of a nozzle forming substrate having nozzle holes for ejecting liquid droplets, the surface being on a droplet ejection side of the nozzle forming substrate, the method comprising the steps of: a spreading step of spreading sealing members for sealing the nozzle holes, on the surface of the nozzle forming substrate on the droplet ejection side; a drawing step of drawing the sealing members by suction through the nozzle holes, from another side of the nozzle forming substrate reverse to the droplet ejection side; a first removal step of removing a surplus of the sealing members present on the surface of the nozzle forming substrate on the droplet ejection side; an application step of applying a liquid-repelling agent onto the surface of the nozzle forming substrate on the droplet ejection side; a curing step of curing the liquid-repelling agent applied to the surface of the nozzle forming substrate on the droplet ejection side; and a second removal step of removing the sealing members from the nozzle holes.

According to the present invention, it is possible readily to seal off the nozzle holes by means of the sealing members, by drawing the sealing members spread over the surface of the nozzle forming substrate on the droplet ejection side, by suction through the nozzle holes. Furthermore, it is also possible to remove the sealing members readily from the nozzle holes, after applying the liquid-repelling agent to the surface of the nozzle forming substrate on the droplet ejection side. Consequently, the process of manufacturing the nozzle plate formed with the liquid-repelling film on the surface on the droplet ejection side is simplified. Furthermore, it is also possible to reuse the sealing members, and therefore the manufacturing costs of the nozzle plates can be reduced.

Preferably, the curing step includes a semi-curing step of changing the liquid-repelling agent to a semi-cured state, and a full-curing step of changing the liquid-repelling agent from the semi-cured state to a fully cured state; and the liquid-repelling agent applied to the surface of the nozzle forming substrate on the droplet ejection side is changed to the semi-cured state before the second removal step, and is then changed to the fully cured state after the second removal step. According to this aspect of the present invention, it is possible to readily remove the sealing members that seal off the nozzle holes.

Preferably, the drawing step comprises a measurement step of measuring a value of suction pressure of the suction; and the drawing step is performed until the measured value of the suction pressure becomes not less than a prescribed value. According to this aspect of the present invention, it is possible to confirm the sealed state of the nozzle holes by means of the sealing members, on the basis of the suction pressure, and therefore the nozzle holes can be sealed in a reliable fashion.

Preferably, the nozzle holes have at least partially tapered shapes in which internal diameters of the nozzle holes become larger toward ends thereof on the surface of the nozzle forming substrate on the droplet ejection side. According to this aspect of the present invention, when the sealing members are drawn by suction through the nozzle holes from the opposite side to the droplet ejection side of the nozzle forming substrate, then the sealing members enter readily into the tapered sections of the nozzle holes, and hence the nozzle holes can be sealed readily.

Preferably, the sealing members have a substantially spherical shape. According to this aspect of the present invention, it is possible to seal the nozzle holes readily.

Preferably, the sealing members are made of elastic bodies. According to this aspect of the present invention, it is possible to make the sealing members adhere closely to the nozzle holes without creating gaps, and hence the nozzle holes can be sealed in a reliable fashion.

In order to attain the aforementioned object, the present invention is also directed to a nozzle plate, comprising: a nozzle forming substrate which has nozzle holes for ejecting liquid droplets, the nozzle holes having tapered sections in which internal diameters of the nozzle holes become larger toward ends thereof on a surface of the nozzle forming substrate on a droplet ejection side; and a liquid-repelling film which is formed on the surface of the nozzle forming substrate on the droplet ejection side and is also formed on surfaces of the tapered sections.

According to the present invention, the liquid droplets are not liable to adhere to the tapered sections of the nozzle holes, and the ejection characteristics, such as the volume and flight direction of the liquid droplets ejected from the nozzle holes, are stabilized.

Preferably, the liquid-repelling film formed on the surfaces of the tapered sections becomes thicker toward the ends of the tapered sections on the surface of the nozzle forming substrate on the droplet ejection side. According to this aspect of the present invention, the wear resistance of the liquid-repelling film formed on the tapered sections is improved.

According to the present invention, it is possible readily to seal off the nozzle holes by means of the sealing members, by drawing the sealing members spread over the droplet ejection side of the nozzle forming substrate, by suction through the nozzle holes. Furthermore, it is also possible to remove the sealing members readily from the nozzle holes, after applying the liquid-repelling agent to the surface of the nozzle forming substrate on the droplet ejection side. Consequently, the process of manufacturing the nozzle plate formed with the liquid-repelling film on the surface on the droplet ejection side is simplified. Furthermore, it is also possible to reuse the sealing members, and therefore the manufacturing costs of the nozzle plates can be reduced.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
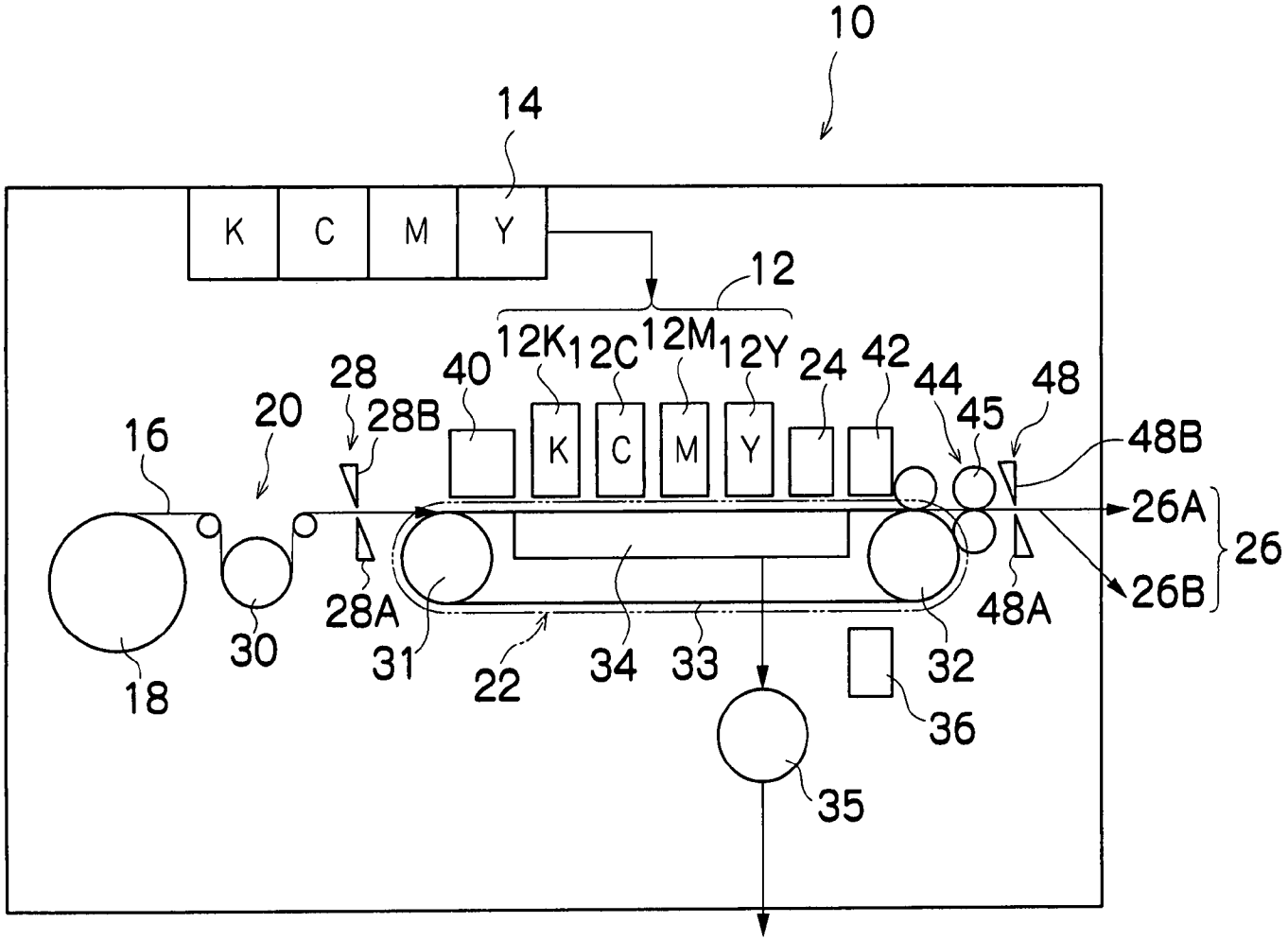
FIG. 1 is a general compositional view showing an inkjet recording apparatus according to the present invention.

FIG. 1 is a general schematic drawing of an inkjet recording apparatus which forms an image forming apparatus according to the present invention. As shown in FIG. 1, the inkjet recording apparatus 10 comprises: a print unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the print unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub-scanning direction). The print heads 12K, 12C, 12M and 12Y forming the print unit 12 are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main scanning direction) which is perpendicular to the paper conveyance direction (sub-scanning direction).

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and the tanks are connected to the print heads 12K, 12C, 12M and 12Y, through tube channels (not shown). Moreover, the ink storing and loading unit 14 also comprises a notifying device (display device, alarm sound generator, or the like) for generating a notification if the remaining amount of ink has become low, as well as having a mechanism for preventing incorrect loading of ink of the wrong color.

The print determination unit 24 has an image sensor (line sensor and the like) for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and determines the ejection of each head. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Structure of Print Heads

Next, the structure of the print head is described. The print heads 12K, 12M, 12C and 12Y provided for the respective ink colors have the same structure, and a reference numeral 50 is hereinafter designated to a representative embodiment of these print heads.

Figure 2:
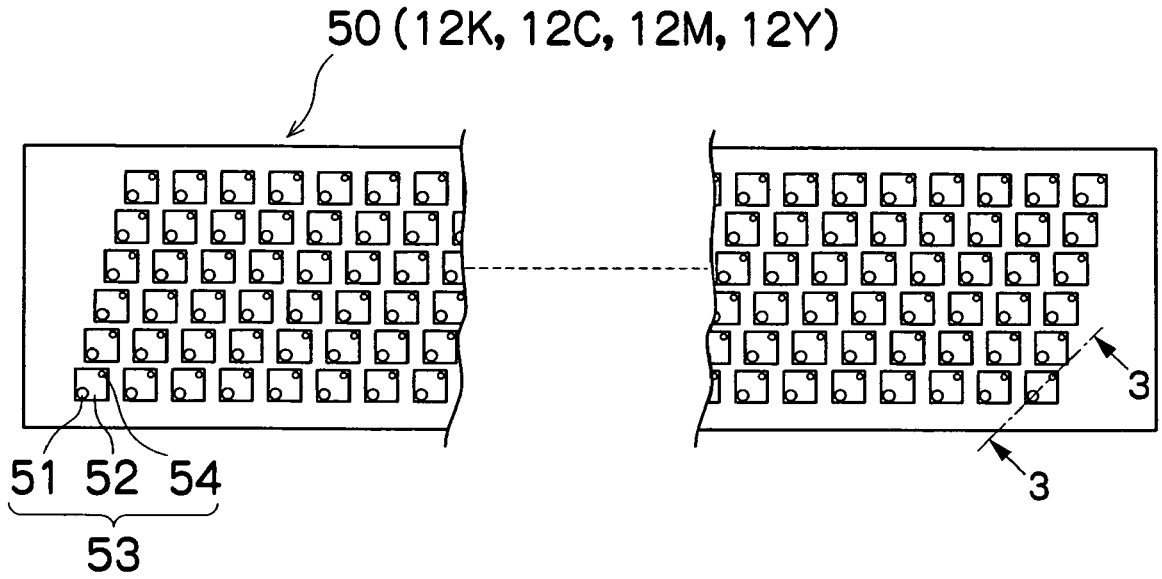
FIG. 2 is a plan perspective diagram showing an embodiment of the structure of a print head.
Figure 3:
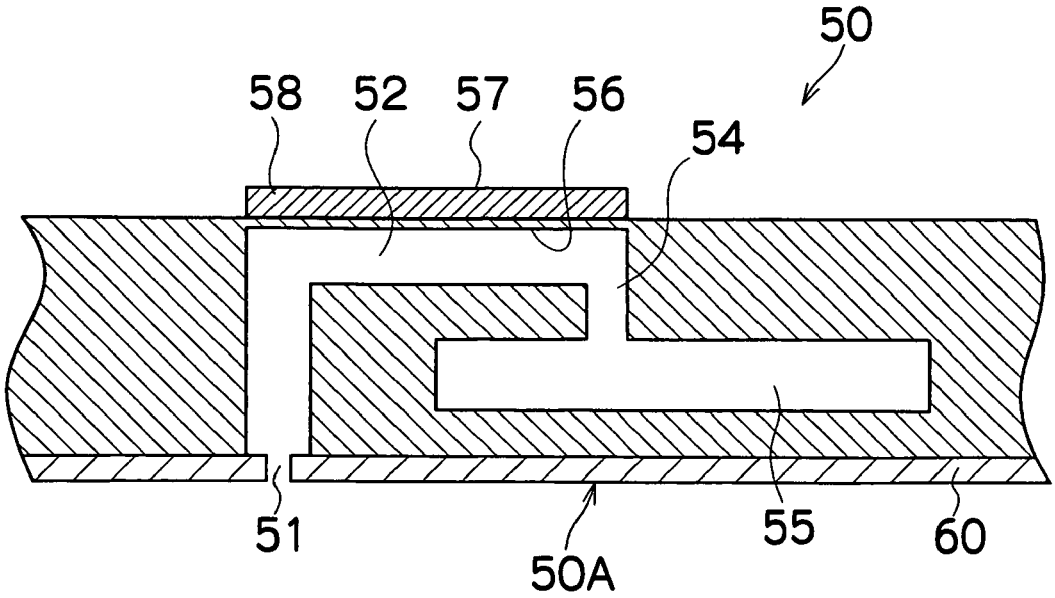
FIG. 3 is a cross-sectional diagram along line 3-3 in FIG. 2.

FIG. 2 is a plan view perspective diagram showing the embodiment of the structure of a print head 50. FIG. 3 is a cross-sectional diagram (along line 3-3 in the FIG. 2) showing the three-dimensional composition of one of droplet ejection elements (an ink chamber unit corresponding to one nozzle 51).

The nozzle pitch in the print head 50 should be minimized in order to maximize the resolution of the dots printed on the surface of the recording paper. As shown in FIG. 2, the print head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the print head (the direction perpendicular to the paper conveyance direction) is reduced and high nozzle density is achieved.

As shown in FIG. 2, the planar shape of the pressure chamber 52 provided for each nozzle 51 is substantially a square, and the nozzle 51 and an inlet of supplied ink (supply port) 54 are disposed in both corners on a diagonal line of the square.

As shown in FIG. 3, the nozzle surface (ink ejection surface) 50A of the print head 50 is constituted by a nozzle plate 60 in which nozzles (nozzle holes) 51 are formed. The method of manufacturing the nozzle plate 60 is described later in detail.

Each pressure chamber 52 is connected through a supply opening 54 to a common flow channel 55. The common flow channel 55 is connected to an ink tank (not shown), which is a base tank that supplies ink, and the ink supplied from the ink tank is delivered through the common flow channel 55 to the pressure chambers 52.

An actuator 58 provided with an individual electrode 57 is joined to a pressure plate (common electrode) 56 which forms the upper face of each pressure chamber 52. The actuator 58 is deformed when a drive voltage is supplied to the individual electrode 57 and the common electrode 56, and the volume of the pressure chamber 52 is changed, thereby causing ink to be ejected from the nozzle 51. A piezoelectric element including a piezoelectric body is suitable as the actuator 58. When ink is ejected, new ink is supplied to the pressure chamber 52 from the common flow channel 55 through the supply port 54.

Figure 4:
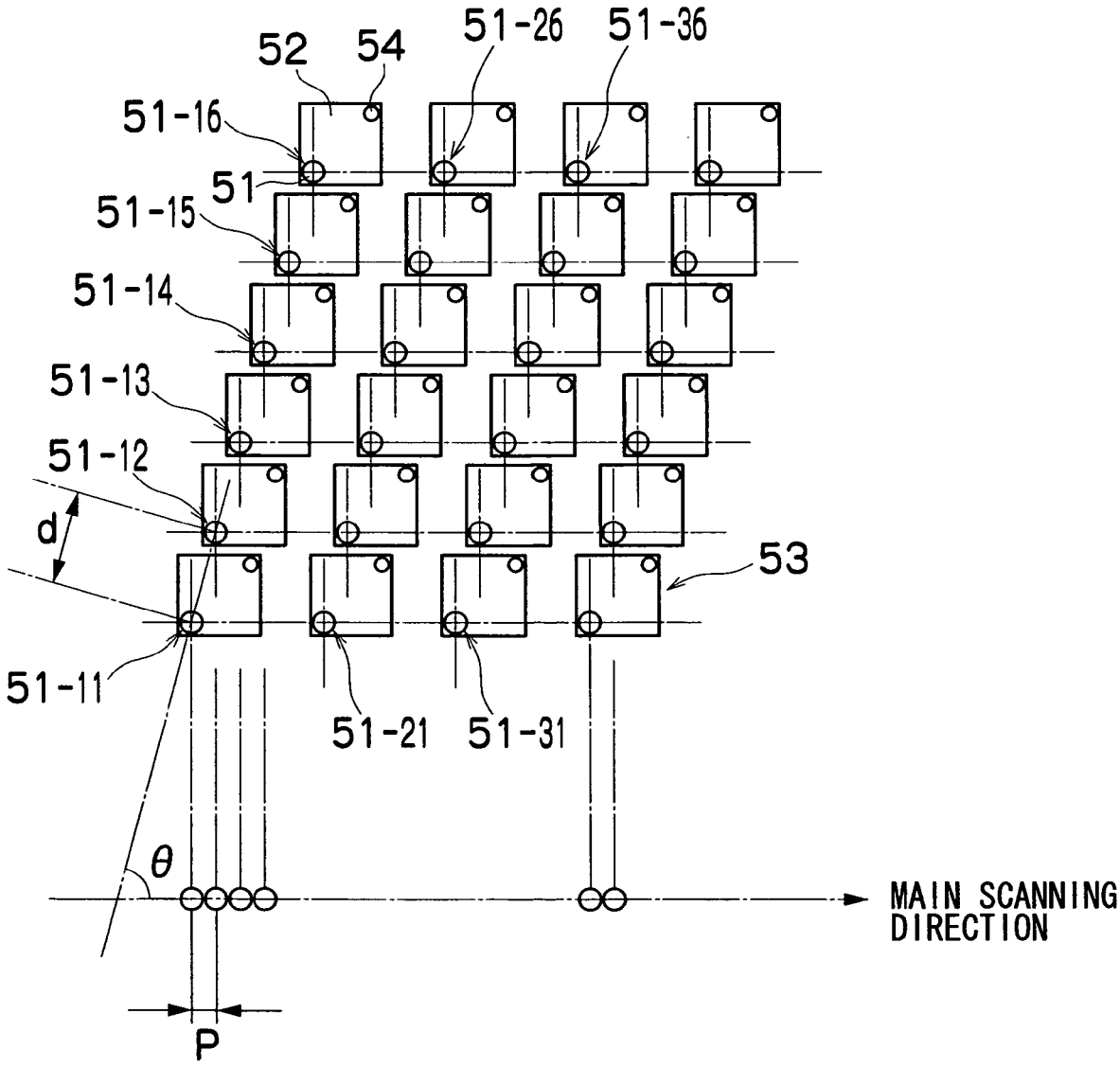
FIG. 4 is an enlarged view showing an embodiment of the nozzle arrangement in the print head shown in FIG. 2.

As shown in FIG. 4, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of $\theta$ with respect to the main scanning direction. By adopting a structure wherein a plurality of ink chamber units 53 are arranged at a uniform pitch d in a direction having an angle $\theta$ with respect to the main scanning direction, the pitch P of the nozzles when projected to an alignment in the main scanning direction is $d \times \cos\theta$.

More specifically, the arrangement can be treated equivalently to one in which the respective nozzles 51 are arranged in a linear fashion at a uniform pitch P, in the main scanning direction. By means of this composition, it is possible to achieve a nozzle composition of high density, in which the nozzle columns projected to align in the main scanning direction reach a total of 2,400 per inch (2,400 nozzles per inch).

In a full-line head comprising rows of nozzles that have a length corresponding to the entire width of the image recordable width, the "main scanning" is defined as printing one line or one strip in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 4 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording paper 20 by sequentially driving the nozzles 51-11, 51-12, . . . , 51-16 in accordance with the conveyance velocity of the recording paper 20.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the embodiment illustrated. Moreover, a method is employed in the present embodiment where an ink droplet is ejected by means of the deformation of the actuator 58, which is typically a piezoelectric element; however, in implementing the present invention, the method used for discharging ink is not limited, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Method for Manufacturing Nozzle Plate

FIGS. 5A to 5H are illustrative diagrams showing steps of manufacturing the nozzle plate 60. Below the method of manufacturing the nozzle plate 60 which is characteristic of the present invention is described with reference to these diagrams.

Figure 5A:
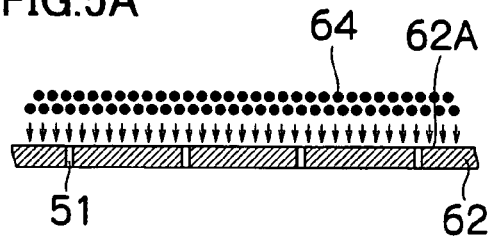
FIGS. 5A to 5H are illustrative diagrams showing steps of manufacturing a nozzle plate.

Firstly, as shown in FIG. 5A, a thin plate-shaped nozzle forming substrate 62 made of a metal, such as stainless steel, is processed to form nozzle holes (nozzles) 51 therein, by means of machine processing, laser processing, etching, or the like, and sealing members 64 for sealing off the nozzle holes 51 are spread over the surface (the ink ejection surface) 62A of the nozzle forming substrate 62 on the ink ejection side. The sealing members 64 are constituted by elastic bodies having an approximately spherical shape, and the details of the sealing members 64 are described later.

Figure 5B:
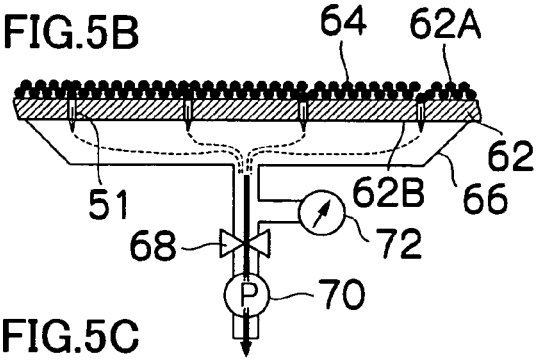

Thereupon, as shown in FIG. 5B, the sealing members 64 having been spread over the ink ejection surface 62A are drawn by suction through the nozzle holes 51 from the side on the other surface (the ink flow channel surface) 62B of the nozzle forming substrate 62 reverse to the ink ejection surface 62A. For example, as shown in FIG. 5B, the side on the ink flow channel surface 62B of the nozzle forming substrate 62 is closed off with a hermetic cover 66, a valve 68 is opened and a pump 70 is operated to provide suction, thereby sucking out the air of the side on the ink flow channel surface 62B closed off with the hermetic cover 66 and drawing the sealing members 64 by suction through the nozzle holes 51, while measuring the pressure of the side on the ink flow channel surface 62B with a pressure gauge 72. Consequently, a portion of the sealing members 64 having been spread over the ink ejection surface 62A of the nozzle forming substrate 62 seal off the nozzle holes 51A from the side on the ink ejection surface 62A, while the remainder of the sealing members 64 remain on the ink ejection surface 62A, as surplus sealing members 64. It is also possible to draw the sealing members 64 by suction through the nozzle holes 51 from the side on the ink flow channel surface 62B, at the same time as spreading the sealing members 64 over the ink ejection surface 62A.

Figure 5C:
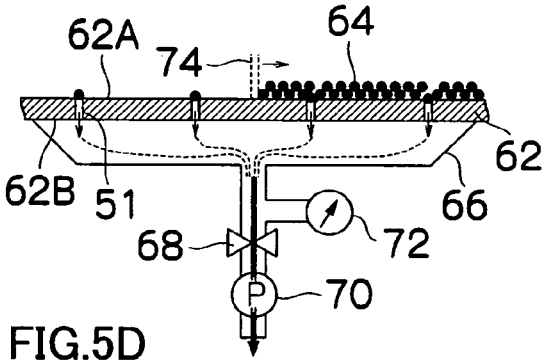

Next, as shown in FIG. 5C, the ink ejection surface 62A is scanned by an air curtain 74, while continuing to apply suction from the side on the ink flow channel surface 62B. This action removes the surplus sealing members 64 remaining on the ink ejection surface 62A of the nozzle forming substrate 62 (in other words, the sealing members 64 that are not sealing off the nozzle holes 51). The sealing members 64 removed by the air curtain 74 can be reused.

Figure 5D:
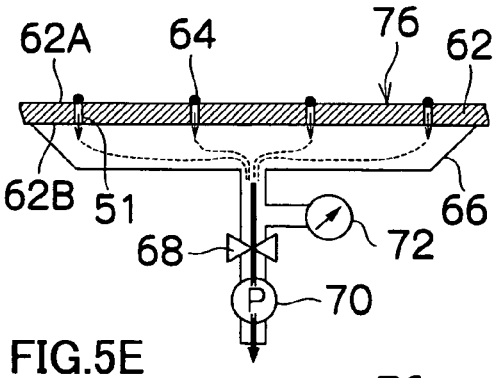
Figure 5E:
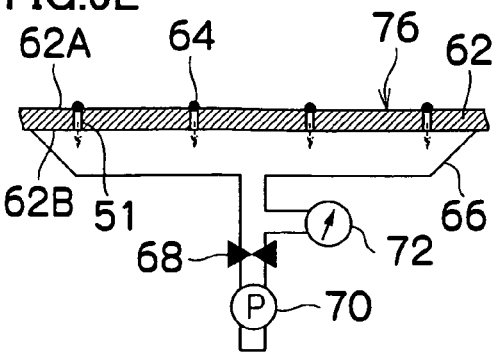

Thereupon, as shown in FIG. 5D, the pressure (suction pressure) is measured with the pressure gauge 72. If the value of the suction pressure measured with the pressure gauge 72 is less than a specified value (i.e., the measured pressure is between the atmospheric pressure and a specified pressure below the atmospheric pressure), then it is determined that there is a nozzle hole 51 that has not yet been sealed off by a sealing member 64, and hence the process of spreading the sealing members 64 from the side on the ink ejection surface 62A and drawing from the ink flow channel surface 62B is carried out again. The process described above is repeated until the suction pressure measured by the pressure gauge 72 is equal to or greater than the specified value.

In this way, it is possible to confirm the sealed state of the nozzle holes 51 by means of the sealing members 64 on the basis of the pressure (suction pressure) measured with the pressure gauge 72, and even if the nozzle holes 51 are very fine, the sealed state of the nozzle holes 51 by the sealing members 64 can be confirmed to a high degree of accuracy.

If the value of the suction pressure measured with the pressure gauge 72 is equal to or greater than the specified value (i.e., the measured pressure is equal to the specified pressure or further from the atmospheric pressure than the specified pressure), then it is determined that all of the nozzle holes 51 have been sealed off by the sealing members 64, and a liquid-repelling agent 76 is then applied to the ink ejection surface 62A of the nozzle forming substrate 62. In this case, desirably, the pressure (negative pressure) of the side on the ink flow channel surface 62B of the nozzle forming substrate 62 is maintained uniform, and furthermore, desirably, the valve 68 is closed and the pump 70 is halted, thereby closing off the side on the ink flow channel surface 62B, which is hermetically sealed by the hermetic cover 66, in such a manner that there are no effects due to the pressure fluctuations and mechanical vibrations in the pump 70. Furthermore, if the nozzle forming substrate 62 is formed with a large number of nozzles, or if the nozzle forming substrate 62 is formed to a large size, then it is desirable that the pressure of the side on the ink flow channel surface 62B is reduced (brought near to the atmospheric pressure) in comparison with the step shown in FIG. 5B, and the liquid-repelling agent 76 is applied once the pressure has become uniform. This prevents warping of the nozzle forming substrate 62, and makes it possible to apply the liquid-repelling agent 76 to the ink ejection surface 62A of the nozzle forming substrate 62 in an even and uniform fashion.

The method of applying the liquid-repelling agent 76 may be spin-coating, vapor deposition, spraying, or the like. Spin-coating is more suitable for forming a thick film than vapor deposition or spraying. On the other hand, in the case of vapor deposition or spraying, there is a probability that the film is also formed on the surfaces of the sealing members 64, and it is then necessary to clean the surfaces of the sealing members 64 before finally removing the sealing members 64. Consequently, it is desirable to use a spin-coating method to apply the liquid-repelling agent 76 to the ink ejection surface 62A of the nozzle forming substrate 62.

Figure 5F:
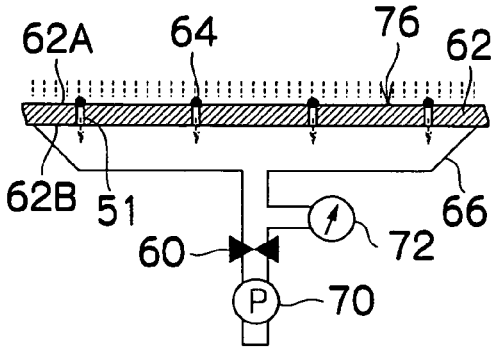

Thereupon, as shown in FIG. 5F, the liquid-repelling agent 76 having been applied to the ink ejection surface 62A of the nozzle forming substrate 62 is cured (hardened). During this, the pressure (negative pressure) of the side on the ink flow channel surface 62B of the nozzle forming substrate 62 is maintained in the same state as during the application of the liquid-repelling agent 76. The conditions for curing the liquid-repelling agent 76 vary depending on the type of liquid-repelling agent 76 used.

In the present embodiment, if it is possible to set the liquid-repelling agent 76 to a state of increased viscosity (a semi-cured state), then it is desirable to set the liquid-repelling agent 76 to the semi-cured state at this stage, rather than to a fully cured state. If the liquid-repelling agent 76 is a thermally curable material, then it is possible to cure the liquid-repelling agent 76 to a semi-cured state by heating at a low temperature. For example, in the case of a liquid-repelling agent 76 having curing properties of 1 hour at a curing temperature of 180° C., then it is desirable that the liquid-repelling agent is heated for 1 hour at 100° C., or for 30 minutes at 120° C., for example. If the liquid-repelling agent 76 is curable by ultraviolet light, then it is desirable that the ultraviolet light irradiation time is shortened accordingly. If the liquid-repelling agent 76 requires heat treatment, then it is desirable that the heat treatment is not carried out at this point.

Figure 5G:
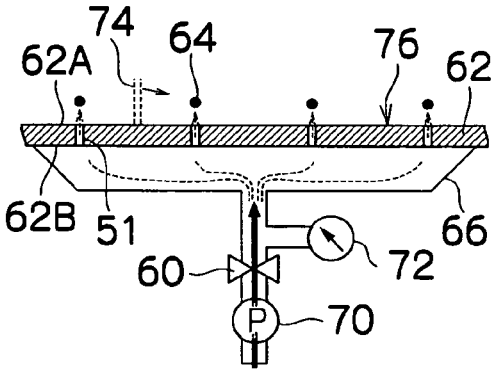

Thereupon, as shown in FIG. 5G, the valve 68 is opened and the pump 70 is operated to provide positive pressure, and the pressure over the atmospheric pressure is applied to the sealing members 64 that are sealing the nozzle holes 51, from the side on the ink flow channel surface 62B, through the nozzle holes 51. Thereby, the sealing members 64 are blown upward and removed from the nozzle holes 51. These sealing members 64 are removed by the air curtain 74. The sealing members 64 thus removed can be reused. It is also possible to remove the sealing members 64 from the nozzle holes 51 after inverting the nozzle forming substrate 62 in such a manner that the ink ejection surface 62A faces in the downward direction in FIG. 5G.

Figure 5H:
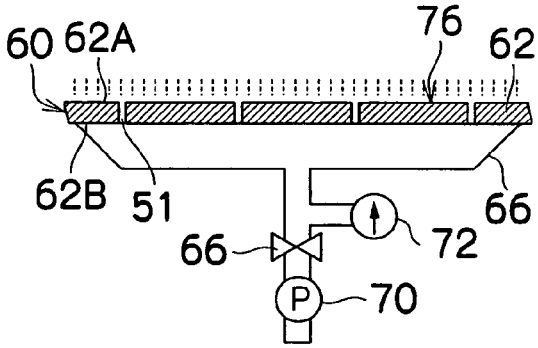

If the liquid-repelling agent 76 is in the semi-cured state, then as shown in FIG. 5H, a process corresponding to the type of liquid-repelling agent 76 is carried out (namely, heating, irradiation of ultraviolet light, or the like), and the liquid-repelling agent 76 is thus converted to a fully cured state.

In this way, it is possible to manufacture a nozzle plate 60 having the liquid-repelling agent (liquid-repelling film) 76 formed on the ink ejection surface 62A of the nozzle forming substrate 62 having the nozzle holes 51. If burring occurs in the liquid-repelling agent 76 in the vicinity of the nozzle opening sections, during the removal of the sealing members 64 from the nozzle holes 51 in the step shown in FIG. 5G, then desirably, this burring is removed by sandblasting, heat treatment, or the like.

Structure of Sealing Members

Figure 6:
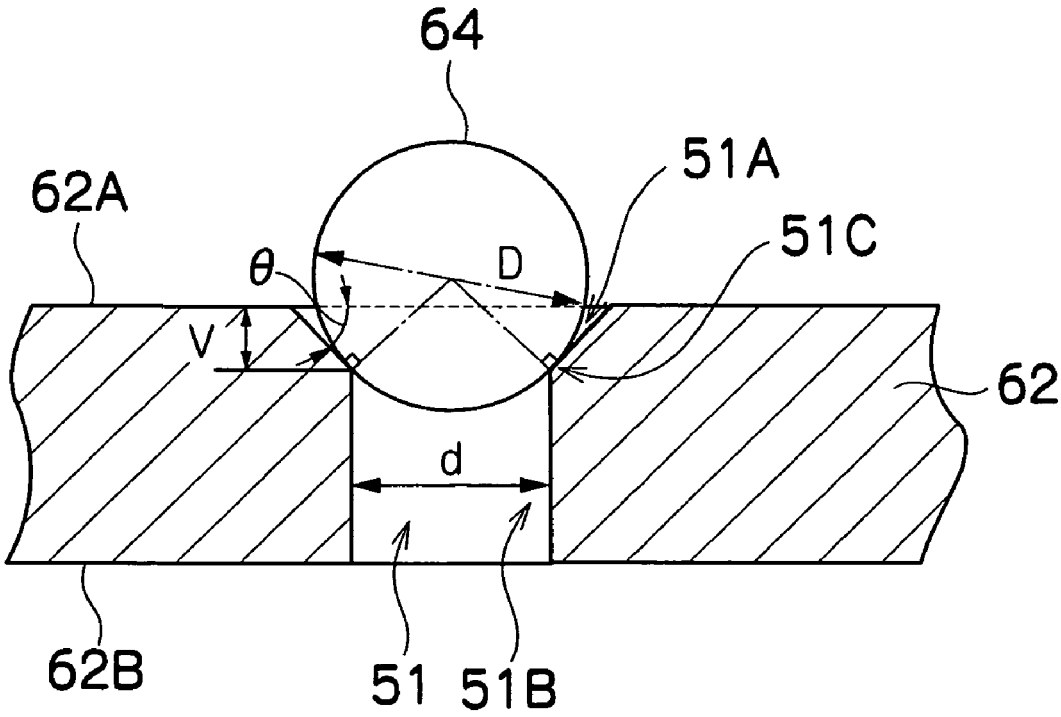
FIG. 6 is an enlarged cross-sectional diagram of a nozzle hole in a nozzle forming substrate.

Next, the structure of the sealing members 64 is described. FIG. 6 is an enlarged cross-sectional diagram of the nozzle hole 51 in the nozzle forming substrate 62 in a state the nozzle hole 51 is sealed off by the sealing member 64.

In the present embodiment, the sealing member 64 is an approximately spherical shape and is constituted by an elastic body made of silicone, polyimide, or the like. The nozzle hole 51 has a tapered section 51A, in which the internal diameter of the nozzle hole 51 becomes larger toward the end thereof on the ink ejection surface 62A, and a cylindrical section 51B having the same diameter as the minimum diameter of the tapered section 51A.

In order to stabilize the ejection characteristics, such as the volume and the speed of flight of the ink droplets ejected from the nozzle hole 51, it is necessary to prevent the liquid-repelling agent 76 from entering into the cylindrical section 51B of the nozzle hole 51. Therefore, as shown in FIG. 6, the nozzle hole 51 must be sealed off reliably, in such a manner that the sealing member 64 is caught at the section where the tapered section 51A and the cylindrical section 51B connect together, namely, the section having the minimum diameter in the tapered section 51A (hereinafter referred to as the minimum diameter section 51C). In other words, it is necessary to adopt a composition in which the sealing member 64 makes contact with the minimum diameter section 51C of the nozzle hole 51. Hence, if the angle of taper of the tapered section 51A of the nozzle hole 51 is θ and the internal diameter of the minimum diameter section 51C is d, then the diameter D of the sealing member 64 satisfies the following condition (1):

$$D \leq \frac{d}{\sin\theta}. \tag{1}$$

Furthermore, in order that the sealing members 64 can be removed readily from the nozzle holes 51 after applying the liquid-repelling agent 76 to the ink ejection surface 62A of the nozzle forming substrate 62, it is necessary to adopt a composition in which the center of each sealing member 64 is situated to the outside of the ink ejection surface 62A of the nozzle forming substrate 62 (to the upper side in FIG. 6), as shown in FIG. 6. Therefore, if the depth of the tapered section 51B in the nozzle hole 51 is v, then the diameter D of the sealing member 64 satisfies the following condition (2):

$$D \geqq \sqrt{d^2+4v^2}. \tag{2}$$

Consequently, the sealing member 64 satisfying the above-described conditions (1) and (2) is able to seal off the nozzle hole 51 reliably, in such a manner that the liquid-repelling agent 76 does not enter into the cylindrical section 5B of the nozzle hole 51, while at the same time, the sealing member 64 can be removed readily from the nozzle hole 51 after application of the liquid-repelling agent 76.

For example, if the angle of taper θ of the tapered section 51A of the nozzle hole 51 is 45°, the depth v of the tapered section 51A is 10 μm, and the internal diameter d of the minimum diameter section 51C is 30 μm, then the diameter D of the sealing member 64 desirably satisfies the following condition (3):

$$36.1\ \mu\text{m} \leqq D \leqq 42.4\ \mu\text{m}. \tag{3}$$

Figure 7:
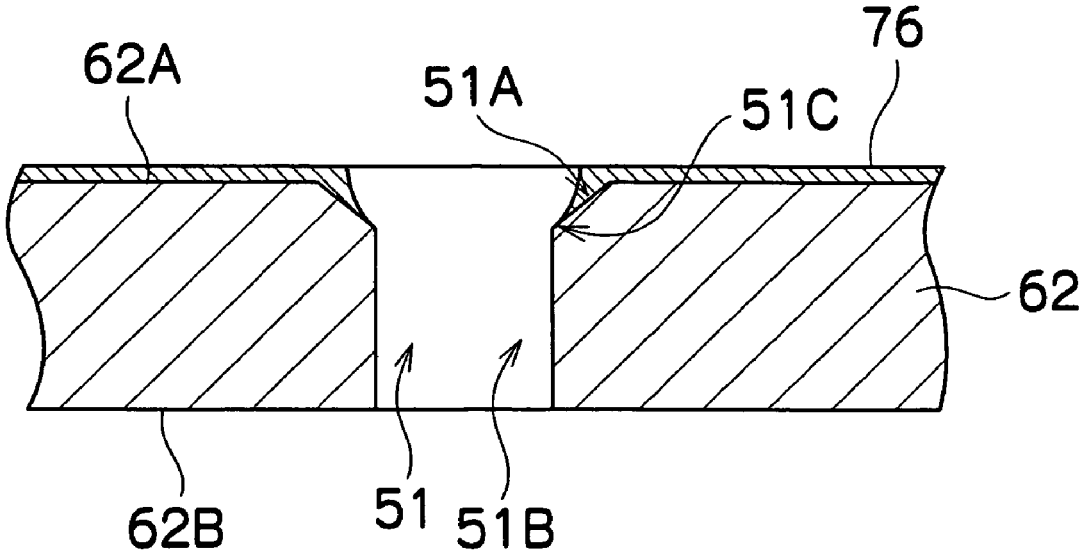
FIG. 7 is an enlarged cross-sectional diagram of the nozzle hole in the nozzle forming substrate.

FIG. 7 is an enlarged cross-sectional diagram of the nozzle hole 51 in the nozzle forming substrate 62 on which the liquid-repelling agent (liquid-repelling film) 76 has been formed on the ink ejection surface 62A, in a state after the sealing members 64 (not shown in FIG. 7) have been removed. By using the sealing member 64 that satisfies the above-described conditions (1) and (2), it is possible to remove the sealing member 64 readily from the nozzle hole 51, as shown in FIG. 7. The liquid-repelling agent (liquid-repelling film) 76 is formed on the surface of the tapered section 51A of the nozzle hole 51, following the external shape of the sealing member 64, which is approximately spherical in shape. The liquid-repelling agent (liquid-repelling film) 76 is formed in such a manner that it gradually becomes thicker from the minimum diameter section 51C, toward the ink ejection surface 62. The liquid-repelling agent (liquid-repelling film) 76 formed on the tapered section 51A of the nozzle hole 51 in this way is formed at a uniform depth in the nozzle hole 51, and it has excellent resistance to wear.

Furthermore, in the present embodiment, if the film thickness t of the liquid-repelling agent 76 formed on the ink ejection surface 62A of the nozzle forming substrate 62 is not of a negligible size compared to the depth v of the tapered section 51A, then desirably, instead of the above-described condition (2), the following condition (4) is satisfied to take account of the film thickness t of the liquid-repelling agent 76:

$$D \geqq \sqrt{d^2+4(v+t)^2}. \tag{4}$$

Figure 8A:
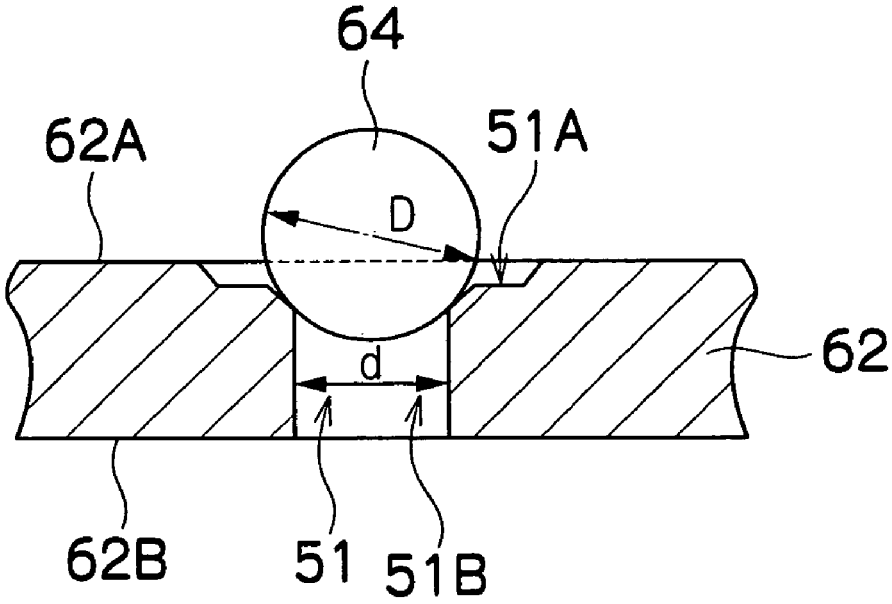
FIGS. 8A and 8B are enlarged cross-sectional diagrams showing further modes of a nozzle hole.
Figure 8B:
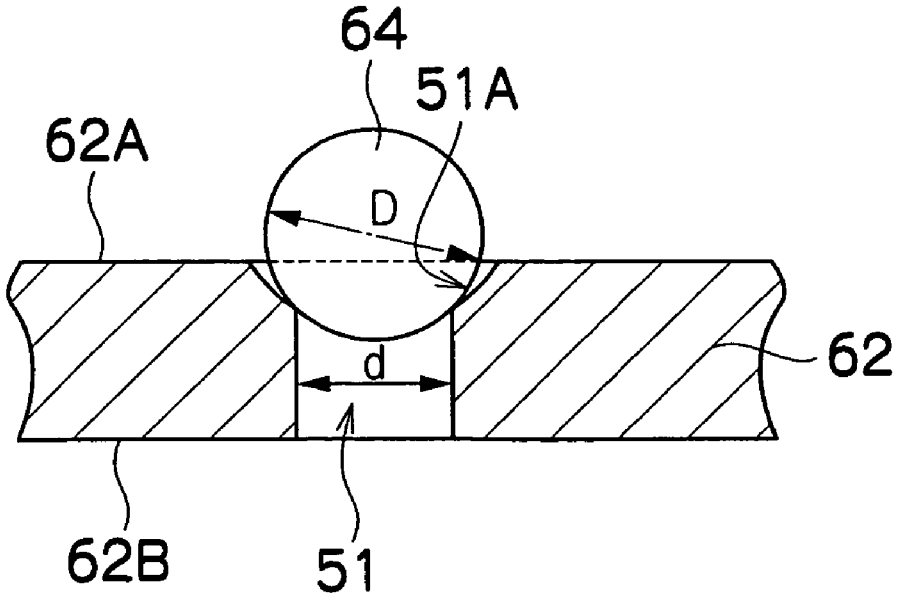

The tapered section 51A of the nozzle hole 51 is not limited to having a linear shape as shown in FIGS. 6 and 7, and it may also have a stepped shaped as shown in FIG. 8A, or a curved shape as shown in FIG. 8B.

In the present embodiment, since the sealing member 64 is constituted by an elastic body as described above, then the sealing member 64 makes close contact with the nozzle hole 51, without producing any gaps, and is therefore able to seal off the nozzle hole 51 in a reliable fashion. Therefore, even if there is some variation in the dimensional accuracy of the nozzle holes 51, this variation can be absorbed. The desirable value of the hardness of the sealing members 64 varies with factors such as the shape (internal diameter, etc.) of the nozzle holes 51, the wetting properties and viscosity of the liquid-repelling agent 76, the suction pressure applied from the side on the ink flow channel surface 62B of the nozzle forming substrate 62, and the like, but generally, the value of the hardness of the sealing members 64 is desirably A/60/1 or below.

Furthermore, desirably, the sealing members 64 are formed from a uniform material, and more desirably, this material is the same as that used in the nozzle forming substrate 62. If the sealing members 64 and the nozzle forming substrate 62 have the same thermal expansivity, then it is possible to ensure even more reliable sealing of the nozzle holes 51, without any gaps occurring between the nozzle holes 51 and the sealing members 64 when the liquid-repelling agent 76 applied to the ink ejection surface 62A of the nozzle forming substrate 62 is made cured or semi-cured.

A desirable mode has been described as one where the sealing member 64 is formed from a uniform material, but the implementation of the present invention is not limited to this, and the interior of the sealing member 64 may be hollow, or the sealing member 64 may have layers of different materials.

Furthermore, desirably, the surface of the sealing member 64 has high liquid repelling properties and a low coefficient of friction. If the surface of the sealing members 64 has low liquid-repelling properties, then the liquid-repelling agent 76 applied to the ink ejection surface 62A of the nozzle forming substrate 62 will flow onto the sealing members 64 and cover the sealing members 64, and hence it will become impossible to remove the sealing members 64 from the nozzle holes 51. Therefore, the surface of the sealing members 64 should have high liquid-repelling properties. Furthermore, in order that the sealing members 64 can be removed readily from the nozzle holes 51, the surface of the sealing members 64 should have a low coefficient of friction. The surface of the sealing members 64 may be formed by using a resin material, such as epoxy resin, or may be coated with a thin film of a soft liquid-repelling agent, such as amorphous perfluoropolymer resins.

Figure 9:
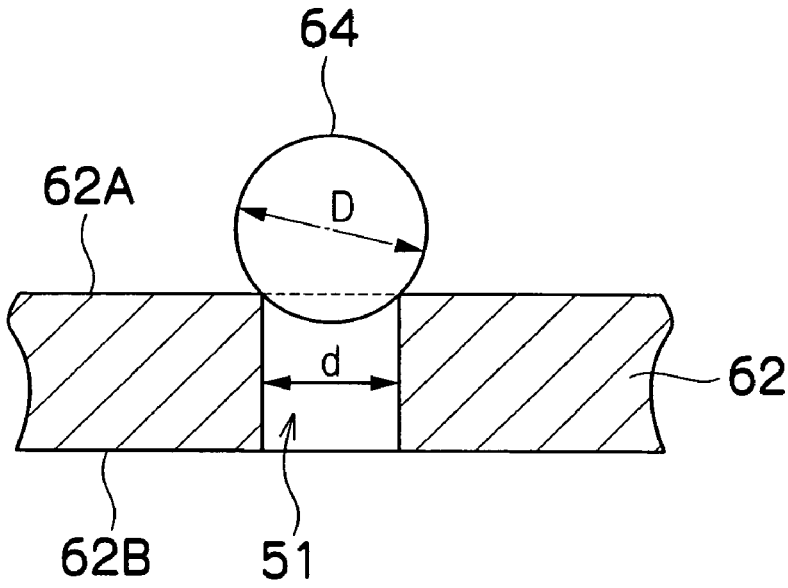
FIG. 9 is an enlarged cross-sectional diagram showing a further mode of a nozzle hole.

In the present embodiment, the shape of the nozzle hole 51 is not limited to one having the tapered section 51A and the cylindrical section 51B. For example, if the nozzle hole 51 is formed in an approximately cylindrical shape with no tapered section, as shown in FIG. 9, then the sealing member 64 is composed so as to have a diameter D that is equal to or greater than the internal diameter d of the nozzle hole 51 (in other words, $D \geqq d$).

Furthermore, a more desirable mode is described as one where the nozzle hole 51 having the tapered section 51A is sealed off by the sealing member 64 having the substantially spherical shape, but the implementation of the present invention is not limited to this, provided that the sealing member 64 is able to seal off the nozzle hole 51, and it is also possible, for example, to seal off a nozzle hole 51 having a pentagonal prismatic shape, by means of a sealing member 64 having a pentagonal dodecahedral shape.

Figure 10:
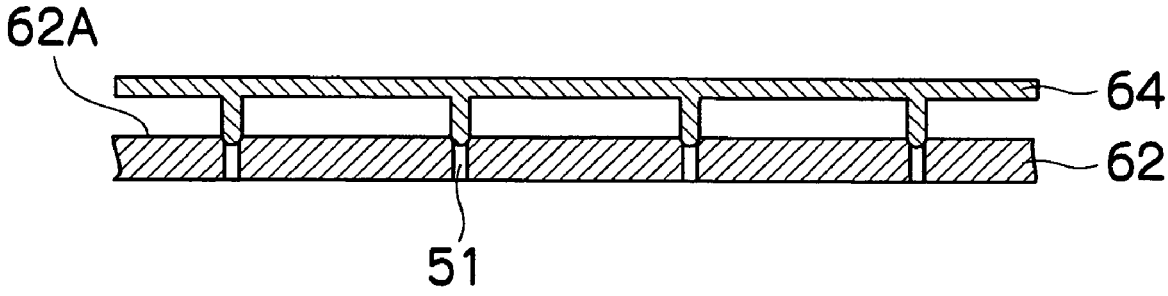
FIG. 10 is a cross-sectional diagram showing a further mode of a sealing member.

Furthermore, as shown in FIG. 10, it is also possible to seal off the nozzle holes 51 together, from the side on the ink ejection surface 62A of the nozzle forming substrate 62, by means of a comb-shaped sealing member 64 formed as a single body.

In the present embodiment, it is possible to seal off the nozzle holes 51 readily by means of the sealing members 64, by drawing the sealing members 64 spread over the ink ejection surface 62A of the nozzle forming substrate 62, by suction through the nozzle holes 51 from the side on the ink flow channel surface 62B. Furthermore, it is also possible readily to remove the sealing members 64 sealing off the nozzle holes 51 by applying pressure from the side on the ink flow channel surface 62B, after the liquid-repelling agent 76 has been applied to the ink ejection surface 62A and has been cured or semi-cured. Therefore, it is possible to manufacture the nozzle plate 60 on which the liquid-repelling agent (liquid-repelling film) 76 is formed on the ink ejection surface 62A of the nozzle forming substrate 62, by means of the simple process.

Furthermore, in the present embodiment, it is possible to reuse the sealing members 64. Desirably, a device is provided for detecting adhesion of the liquid-repelling agent 76 or faults in the sealing members 64, in cases where the liquid-repelling agent 76 becomes attached to the sealing members 64, or the sealing members 64 change in diameter due to a fault in the sealing members 64, or the like, so that the sealing members 64 can be reused. For example, there is a method in which the sealing members 64 that are within a prescribed diameter range can be reused by passing the sealing members 64 through sieves, or a method which uses a determination device that measures the shape by means of a CCD or the like, or measures weight, or optical properties, such as the reflectivity, refractivity or transmissivity.

Furthermore, in the present embodiment, the substantially spherical sealing members 64 satisfying the above-described conditions (1) and (2) are used for the nozzle holes 51 having the tapered sections 51A, in which the internal diameters of the nozzle holes 51 become larger toward the ends thereof on the ink ejection surface 62A of the nozzle forming substrate 62, and therefore, it is possible to ensure reliable clipping points, even if the nozzle plate 60 (nozzle forming substrate 62) has a large number of nozzles or a large size. Moreover, since the sealing members 64 are constituted by the elastic bodies, then the sealing members 64 are able to make close contact with the nozzle holes 51, without producing any gaps, and are therefore able to seal off the nozzle holes 51 in a reliable fashion.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of manufacturing a nozzle plate in which a liquid-repelling film is formed on a surface of a nozzle forming substrate having nozzle holes for ejecting liquid droplets, the surface being on a droplet ejection side of the nozzle forming substrate, the method comprising the steps of:

a spreading step of spreading sealing members for sealing the nozzle holes, over the surface of the nozzle forming substrate on the droplet ejection side;

a drawing step of drawing the sealing members by suction through the nozzle holes, from another side of the nozzle forming substrate opposite to the droplet ejection side;

a first removal step of removing a surplus of the sealing members present on the surface of the nozzle forming substrate on the droplet ejection side;

an application step of applying a liquid-repelling agent onto the surface of the nozzle forming substrate on the droplet ejection side;

a curing step of curing the liquid-repelling agent applied to the surface of the nozzle forming substrate on the droplet ejection side; and a second removal step of removing the sealing members from the nozzle holes.

2. The method as defined in claim 1, wherein:

the curing step includes a semi-curing step of changing the liquid-repelling agent to a semi-cured state, and a full-curing step of changing the liquid-repelling agent from the semi-cured state to a fully cured state; and the liquid-repelling agent applied to the surface of the nozzle forming substrate on the droplet ejection side is changed to the semi-cured state before the second removal step, and is then changed to the fully cured state after the second removal step.

3. The method as defined in claim 1, wherein:

the drawing step comprises a measurement step of measuring a value of suction pressure of the suction; and the drawing step is performed until the measured value of the suction pressure becomes not less than a prescribed value.

4. The method as defined in claim 1, wherein the nozzle holes have at least partially tapered shapes in which internal diameters of the nozzle holes become larger toward ends thereof on the surface of the nozzle forming substrate on the droplet ejection side.

5. The method as defined in claim 1, wherein the sealing members have a substantially spherical shape.

6. The method as defined in claim 1, wherein the sealing members are made of elastic bodies.

* * * * *